United States Patent [19]

Perrig

[11] 4,147,508

[45] Apr. 3, 1979

[54] SIMULTANEOUS DYEING AND BONDING OF POLYAMIDE FIBERS

[75] Inventor: Max Perrig, Arlesheim, Switzerland

[73] Assignee: Sandoz Ltd., Basel, Switzerland

[21] Appl. No.: 836,555

[22] Filed: Sep. 26, 1977

[30] Foreign Application Priority Data

Sep. 29, 1976 [CH] Switzerland ..... 12301/76

[51] Int. Cl.[2] ..... D06P 5/00

[52] U.S. Cl. ..... 8/17; 8/1 XB; 8/18 R; 8/42 B; 8/115.5; 8/130.1; 264/78

[58] Field of Search ..... 8/17, 18 R, 1 XB, 130.1, 8/42 B

[56] References Cited

U.S. PATENT DOCUMENTS 3,574,523 4/1971 Hudson et al. ..... 8/130.1

FOREIGN PATENT DOCUMENTS 819542 3/1975 Belgium.
2125724 11/1972 Fed. Rep. of Germany.
7307113 12/1973 Netherlands.
1487928 10/1977 United Kingdom.

*Primary Examiner*—A. Lionel Clingman
*Attorney, Agent, or Firm*—Gerald D. Sharkin; Richard E. Vila; Thomas C. Doyle

[57] ABSTRACT

Disclosed is a process for the production of a simultaneously dyed and bonded polyamide fibre band which comprises saturating an untwisted polyamide fibre band with an aqueous liquor containing dyestuff and malic, tartaric or citric acid, applying pressure to the band to compact same and remove excess liquor, and subjecting the compacted band to elevated temperatures to cause bonding and dye fixation.

11 Claims, No Drawings

SIMULTANEOUS DYEING AND BONDING OF POLYAMIDE FIBERS

The present invention relates to the production of dyed and bonded polyamide fibre band.

Thus, the invention provides a process for the production of a simultaneously dyed and bonded polyamide fibre band which comprises saturating an untwisted polyamide band with an aqueous liquor containing dyestuff and malic, tartartic or citric acid, applying pressure to the band to compact some and remove excess liquor, and subjecting the compacted band to elevated temperatures to cause bonding and dye fixation.

The saturation of the fibre band with the liquor is suitably carried out by impregnation, e.g. by passage of the band through a bath containing the liquor. The liquor preferably contains from 1 to 500, preferably from 2 to 200, parts by weight of the malic, tartaric or citric acid per 1000 parts total liquor. The amount of dyestuff contained in the liquor will depend primarily on the depth of dyeing required, but is generally of the order of 0.1 to 300, preferably from 5 to 80, parts by weight per 1000 parts of total liquor. The liquor may, as required, contain other additives, e.g. dyeing aids such as formamide, dimethylformamide, polyethylene glycol (mol. wt. 200–200,000 mono-n-butyldiglycol, ethylene glycol monoethylether, cyclohexanol and octyl or nonylphenol polyglycol ethers. The amount of such additional additive, when present, is generally from 1 to 500, preferably 5 to 200, parts by weight per 1,000 parts of total liquor.

The compaction of the saturated fibre band may be carried out in conventional manner, e.g. by passage through a roller nip and/or between rotating compaction discs. The compaction is preferably such that the fibre band, after subjection thereto, has a moisture content of between 20 and 200%, preferably between 20 and 50%, by weight.

The elevated temperature to which the compacted band is subjected is generally of the order of from 80 to 250° C. The elevated temperature conditions may be provided by saturated steam, e.g. at 80 to 100° C., saturated steam under pressure, e.g. at 105 to 160° C., by super heated steam e.g. at from 105° to 250° C., preferably 140° to 180° C., or by dry air, e.g. at from 90° to 250° C., preferably from 140° to 190° C. Depending on the method employed, the band is generally subjected to the elevated temperatures for from 10 seconds to 30 minutes, preferably from 40 to 180 seconds.

After subjection to the elevated temperature the band, where required, may be dried in conventional manner.

The dyestuff employed in the process of the invention may be of any of the classes employed for the dyeing of polyamide substrates, such as acid (especially water soluble) 1:2 metal complex (whether water soluble or not), 1:1 metal complex (whether water soluble or not), insoluble organic pigment, reactive or disperse dyestuffs, and mixtures thereof.

The fibre band obtained by the process of the invention is suitable for tufting or weaving, particularly into carpet form, or for spinning into finer yarn form. The dyeings obtained show notable fastness to washing, rubbing, water and perspiration without the necessity for a rinsing or washing step.

The following Examples, in which all parts and percentages are by weight and the temperatures in degrees centigrade, illustrate the invention.

EXAMPLE 1

The following impregnation bath consisting of the components listed is produced for the simultaneous dyeing and bonding of fibres into an untwisted yarn of polyamide 6:

| | |
|---|---|
| 1.6 | parts of C.I. Reactive yellow 11 |
| 2.4 | parts of C.I. Reactive orange 10 |
| 1.5 | parts of C.I. Reactive Blue RBL 114 |
| 935.0 | parts of water |
| 60.0 | parts of tartaric acid |
| 1000.0 | parts |

A stable fibre band consisting of polyamide 6 (10 den./150 mm staple length) is drafted and fed into a device in which the fibre band passes through from the dye liquid at high pressure and the excess liquid is pressed out between 2 rotating discs at such a rate that only 25% liquid remains on the fibres.

The impregnated fibre band is then treated continuously in a fixation chamber with hot air at 140° for 50 seconds. The dyestuff is fixed during the course of this heat treatment and the fibre band is bonded into an untwisted, dyed yarn or band.

Fixation of the dyestuff and bonding of the fibres to one another can alternatively be achieved by treatment for 10 minutes with saturated steam at 100° or for 60 seconds at 115° under pressure.

In a further alternative method, the compacted yarn is wound onto spools and is given steam treatment for 15 minutes at 100°.

By the above procedure the shade obtained is a pure beige. The yarn is eminently suitable for the production of woven and tufted carpets.

In a similar manner, the yarns of the following colours may be produced by using the following dyestuffs instead of those mentioned above, Bright green:
- 9.5 parts of C.I. Acid Yellow 90
- 12.0 parts of C.I. Acid Yellow 219
- 1.9 parts of C.I. Acid Blue 127:1

Olive green:
- 2.6 parts of C.I. Acid Yellow 90
- 30.0 parts of C.I. Acid Orange 156
- 15.6 parts of C.I. Acid Blue 127:1

In both cases, 60 parts of tartaric acid are used and the amount of water to be added to the above dyestuff portions is such that it makes up 1000 parts.

EXAMPLE 2

Yarns of the following colours may be produced as described in example 1, using 100 parts of citric acid to 1000 parts of impregnation liquor:

Rust:
- 38.0 parts of C.I. Acid Orange 156
- 15.0 parts of C.I. Acid Red 336
- 2.4 parts of C.I. Acid Blue 127:1

Orange:
- 46.0 parts of C.I. Acid Orange 156
- 12.0 parts of C.I. Acid Red 336

Claret:

40.0 parts of C.I. Acid Orange 156
36.0 parts of C.I. Acid Red 57
4.0 parts of C.I. Acid Blue 127:1
Brown:
3.0 parts of C.I. Acid Yellow 219
2.0 parts of C.I. Acid Blue 127:1
21.0 parts of Nylosan dark brown N-GBL The amount of water being made up to 1000 parts.

The fibres which are dyed and bonded together in this way are most suitable for the production of woven and tufted carpets.

Similar results to those obtained in the above Examples can be obtained by replacing the citric or tartaric acid employed therein by the corresponding amount of malic acid.

What we claim is:

1. In a process wherein a band of untwisted polyamide fibers is impregnated with an aqueous liquor containing a dyestuff suitable for dyeing said fibers, the impregnated band is subjected to pressure to compact said band and remove excess liquor and the compacted band is subjected to an elevated temperature of 80° to 250° C. sufficient to cause simultaneous fixation of the dye and bonding of the fibers, the improvement which comprises having present in the aqueous liquor a compound selected from the group consisting of malic, tartaric and citric acids.

2. A process according to claim 1 wherein the dyestuff is selected from the group consisting of acid, 1:2 metal complex, 1:1 metal complex, reactive, disperse and insoluble organic pigment dyestuffs.

3. The process of claim 1, wherein the liquor contains 1 to 500 parts by weight of said acid per 1000 parts total liquor.

4. The process of claim 3, wherein the liquor contains 2 to 200 parts by weight of said acid per 1000 parts total liquor.

5. The process of claim 1, wherein the liquor contains from 0.1 to 300 parts by weight of dyestuff per 1000 parts of total liquor.

6. The process of claim 5, wherein the liquor contains from 5 to 80 parts by weight of dyestuff per 1000 parts of total liquor.

7. The process of claim 1, wherein, after compaction, the fibre band has a moisture content of between 20 and 200% by weight.

8. The process of claim 7, wherein the moisture content between 20 and 50% by weight.

9. The process of claim 1, wherein the liquor contains malic acid.

10. The process of claim 1, wherein the liquor contains tartaric acid.

11. The process of claim 1, wherein the liquor contains citric acid.

* * * * *